United States Patent [19]

Nishio

[11] Patent Number: 4,577,607

[45] Date of Patent: Mar. 25, 1986

[54] CONTROL VALVE DEVICE

[75] Inventor: Shigeru Nishio, Kariya, Japan

[73] Assignee: Aisin Seiki Kabushiki Kaisha, Kariya, Japan

[21] Appl. No.: 610,432

[22] Filed: May 15, 1984

[30] Foreign Application Priority Data

| | | | |
|---|---|---|---|
| May 20, 1983 | [JP] | Japan | 58-087578 |
| Sep. 12, 1983 | [JP] | Japan | 58-168544 |
| Sep. 26, 1983 | [JP] | Japan | 58-177679 |
| Sep. 28, 1983 | [JP] | Japan | 58-181438 |

[51] Int. Cl.[4] ..... F02M 33/02; F02M 5/08

[52] U.S. Cl. ..... 123/516; 123/519; 261/DIG. 67

[58] Field of Search ..... 123/516, 517, 518, 519, 123/520, 521; 261/DIG. 67

[56] References Cited

U.S. PATENT DOCUMENTS

| | | | |
|---|---|---|---|
| 2,917,110 | 12/1959 | Brohl | 123/516 |
| 3,548,797 | 12/1970 | Hagihara | 123/519 |
| 4,258,685 | 3/1981 | Aria et al. | 129/520 |
| 4,387,062 | 6/1983 | Tanaka | 261/DIG. 67 |
| 4,432,328 | 2/1984 | Shimizu | 123/516 |
| 4,446,838 | 5/1984 | Suzuki | 123/519 |
| 4,456,216 | 6/1984 | Boruta | 123/516 |

FOREIGN PATENT DOCUMENTS

| | | | |
|---|---|---|---|
| 45427 | 4/1979 | Japan | 261/DIG. 67 |
| 110548 | 9/1981 | Japan | 123/516 |

*Primary Examiner*—Carl Stuart Miller

*Attorney, Agent, or Firm*—Oblon, Fisher, Spivak, McClelland & Maier

[57] ABSTRACT

A control valve device for use in a carburetor outer vent control system of an automotive internal combustion engine. The device includes a solenoid coil generating a magnetic force and a spring made of a shape memory alloy so that the device may control fluid communication in a fluid passage in response to an input current signal from a switch device and changes in ambient temperature.

7 Claims, 5 Drawing Figures

CONTROL VALVE DEVICE

BACKGROUND OF THE INVENTION

1. Field of the Invention

This invention relates to control valve devices in general, and more particularly to a control valve device which controls fluid communication in a fluid passage in response to both an input current signal from a switch device and changes in an engine ambient temperature.

2. Discussion of the Background

Valve devices of the type to which the present invention is directed are particularly well adapted for use in a carburetor outer vent control system of an automotive internal combustion engine and which prevents fuel evaporative gases produced in a carburetor float chamber from being discharged into the atmosphere. FIG. 1 shows a conventional example of the above carburetor outer vent control system wherein, when an engine ignition switch 11 is turned on to start the engine, an electric current is applied to a solenoid coil 13 from a battery 12 as an electric source. As a result, an electromagnetic valve 14 is maintained closed thereby blocking an fuel evaporative gas passage 15. This electromagnetic valve 14 is a normal open type valve which is maintained to be open when the switch 11 is at off-position. Therefore, the fuel evaporative gases produced in a carburetor float chamber 16 cannot be adsorbed on a canister 17 during engine operation. In this case, the fuel evaporative gases are supplied to the engine through an inner vent tube 18 and an air-fuel induction passage of a carburetor 21, and then are burned.

Next, when the engine is stopped, no electric current is applied to the solenoid coil 13 to thereby maintain the electromagnetic valve open. At this time, the ambient engine temperature is still high and fuel in the float chamber 16 is evaporated. The evaporated fuel gases are adsorbed on the canister 17 by means of the electromagnetic valve 14 positioned in the fuel evaporative gas passage 15 and by means of the thermal responsive control valve 20, thereby preventing the fuel evaporative gases from being discharged into the atmosphere. The control valve 20 is maintained open at a high temperature (over approximately 50° C.), and closed at a low temperature, respectively.

As time proceeds after the engine is stopped, the engine temperature falls. When the temperature falls below a predetermined value, the control valve 20 is maintained closed to thereby prevent the fuel evaporative gases from being adsorbed on the canister 17. However, since the fuel only slightly evaporates owing to the drop of the fuel temperature within the float chamber 16, it is not a serious problem even if adsorption of the canister 17 is interrupted.

As shown in FIG. 1, the carburetor 21 is of the downdraft type having the air-fuel induction passage 19 at one end thereof and connected to an engine intake manifold 22 at the opposite end thereof. The induction passage 19 includes a throttle valve 23 which is rotatably mounted on a part of the carburetor body across the passage 19 in a manner to control the flow of air-fuel mixture into the intake manifold 22.

In the conventional carburetor outer vent control system shown in FIG. 1, however, both the electromagnetic valve 14 operable in response to the ignition switch 11 and the thermal responsive control valve 20 operable in response to changes in the engine temperature are separately constructed. Therefore, the number of parts constituting the control system 10 will increase and then the control system 10 becomes a larger size, whereby it may be difficult to install the control system 10 on the internal combustion engine. Furthermore, the thermal responsive control valve 20 operates in response to changes in an ambient temperature in the vicinity of the carburetor 21. Since this ambient temperature is not exactly the same as the temperature in the carburetor float chamber 16 with the result being that a certain difference in temperature may be observed, the outer vent control system 10 cannot operate with high accuracy in response to changes in the temperature of the float chamber 16.

SUMMARY OF THE INVENTION

A principal object of the present invention, therefore, is to provide a new and improved control valve device which is well adapted for use in a carburetor outer vent control system of an automotive internal combustion engine.

A further object of the present invention is to provide a control valve device wherein an electromagnetic valve and a thermal responsive valve are integrally connected and form a unitary valve body.

Another object of the present invention is to provide a control valve device wherein a spring made of a shape memory alloy is incorporated as a thermal responsive means.

Still another object of the present invention is to provide a control valve device which is economical to manufacture, comparatively simple in construction, and thoroughly reliable in operation.

In one illustrative embodiment of the present invention, there is provided a control valve device which includes a body member having an inlet port and an outlet port, a fluid passage connecting the inlet port and the outlet port, a valve member opening and closing the fluid passage, a first spring biasing the valve member toward the closed position thereof, a solenoid coil forming an magnetic circuit by an applied current, a plunger member positioned in the magnetic circuit and attracted by an inner core upon energization of the solenoid coil, a shaft member fixed in the plunger member at one end thereof and operatively associated with the valve member at the other end thereof, and a second spring biasing the shaft member so that the shaft member may open the valve member against the magnetic force generated by the solenoid coil. The second spring is made of a shape memory alloy so that the spring may be maintained in an expanded shape, which is memorized beforehand, at a high temperature. If the control valve device is incorporated with a carburetor outer vent system for an internal combustion engine, the inlet port is connected with a carburetor outer vent system for an internal combustion engine, the inlet port is connected with a carburetor float chamber and the outlet port is connected with a canister.

When no electric current is applied to the solenoid coil, the movement of the valve member depends on a force balance between the first spring and the second spring. When the temperature in the carburetor float chamber is kept high, the second spring will be maintained in an expanded shape which is memorized beforehand, whereby the load of the second spring is greater than that of the first spring. As a result, the shaft member will be moved by the biasing force of the second spring so that the valve member may be maintained in the opened position thereof, thereby establishing communication between the inlet port and the outlet port. When the temperature in the carburetor float chamber falls below a predetermined value, the second spring will contract. Therefore, the valve member will be maintained closed by a biasing force of the first spring having a greater load than the second spring, thereby blocking the communication between the inlet port and the outlet port.

Upon energization of the solenoid coil, the plunger member is attracted by the inner core, whereby the shaft member fixed in the plunger member is moved in the direction being separated from the valve member. Consequently, the valve member is maintained in the closed position thereof by the biasing force of the first spring. Thus, during the energization of the solenoid coil, the valve member can be maintained in the closed position in spite of changes in temperature, thereby blocking communication between the inlet and outlet port.

A more complete appreciation of the invention and many of the attendant advantages thereof will be readily obtained as the same becomes better understood by reference to the following detailed description when considered in connection with the accompanying drawings, wherein:

DETAILED DESCRIPTION OF PREFERRED EMBODIMENTS

Figure 1:
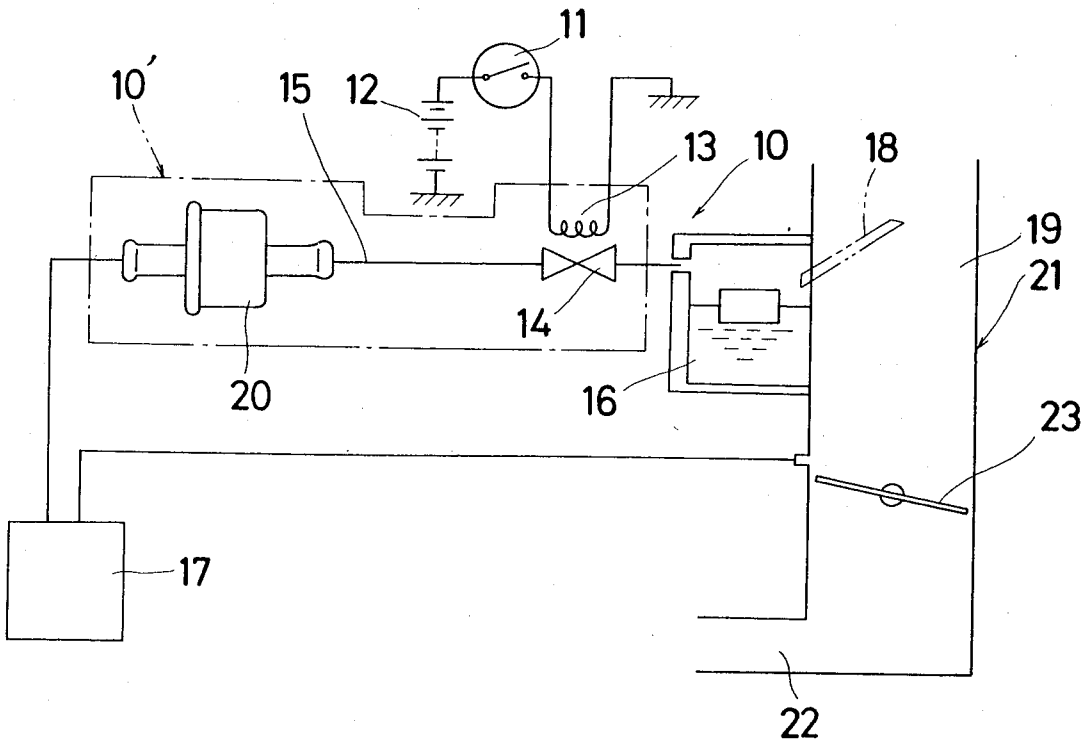
FIG. 1 PRIOR ART
FIG. 1 is a schematic diagram of a conventional carburetor outer vent control system wherein fuel evaporative gases are prevented from being discharged into the atmosphere.
Figure 2:
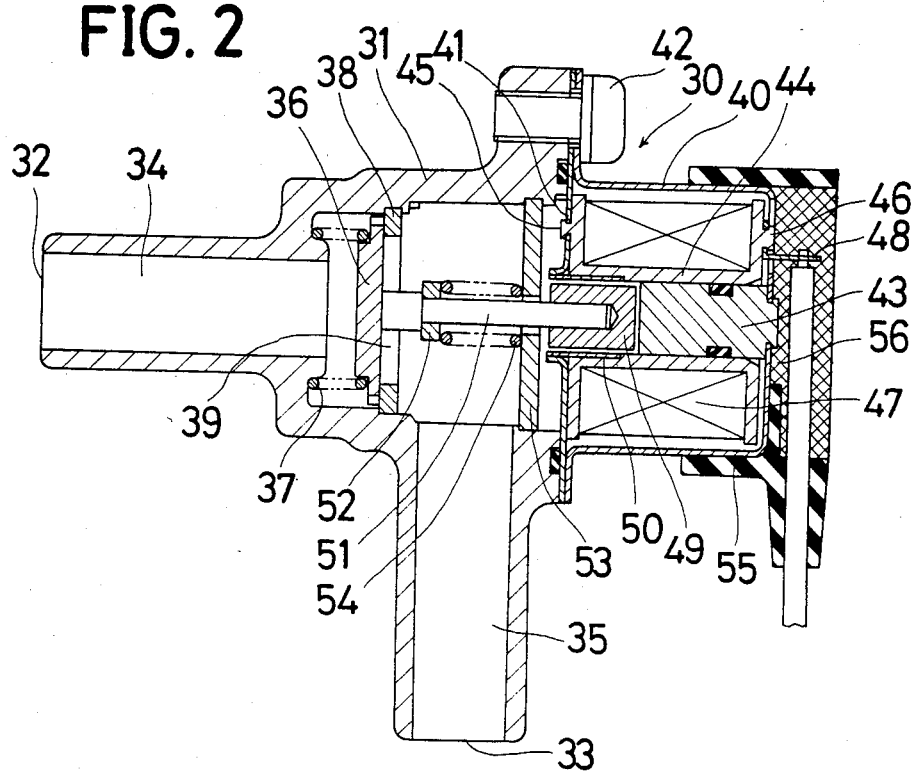
FIG. 2 is a sectional view of a control valve device constructed in accordance with a first embodiment of the present invention and well adapted for a carburetor outer vent control system in an internal combustion engine.

Referring now to FIG. 2 showing a first embodiment of the invention, a control valve device 30 according to the present invention corresponds to a portion indicated by a numeral 10' of FIG. 1. The device 30 includes a body member 31 having a inlet port 32 connected with the carburetor float chamber 16 viewed in FIG. 1 and an outlet port 33 connected with the canister 17 viewed in FIG. 1. The body member 31 is provided with fluid passages 34 and 35 through which the inlet port 32 and the outlet port 33 communicate with each other. Communication between the inlet port 32 and the outlet port 33 is controlled by a valve member 36 positioned between the fluid passages 34 and 35. The valve member 36 is constantly biased by a first spring 37 toward a seat member 38 which is pressed and fixed in an inner wall of the body member 31. The seat member 38 is provided with a penetrating hole 39 at the center thereof through which communication between both the ports 32, 33 is established.

Yokes 40, 41 made of a material of high magnetic permeability are fixedly secured on the rightward opened end of the body member 31 by means of a bolt 42. Disposed within the yokes 41, 42 is an inner core 43 made of a suitable magnetic material. Disposed on the outer periphery of the inner core 43 is a hollow cylindrical bobbin 44, made of a suitable nonmagnetic material, including flanges secured on the yoke 40, 41 by caulkings 45, 46. Wound on the bobbin 44 is a solenoid coil 47 which is electrically connected with a suitable electric source through a terminal 48 to generate a magnetic force. A plunger member 49 made of a suitable magnetic material is slidably disposed on the same axis with the inner core 43 so that the plunger member 49 may face the inner core 43 each other. A tube 50 made of a suitable nonmagnetic material such as brass is pressed and fixed in the bobbin 44, thereby preventing the plunger member 49 from touching the yoke 41. A shaft 51 is fixed in the plunger member 49 at one end thereof and faces the valve member 36 at the opposite end thereof. When the shaft 51 pushes the valve member 36, the valve member 36 will be maintained in the opened position. A ring member 52 is secured to the shaft 51, and a retainer member 53 is secured on the inner wall of the body member 31. Interposed between the ring member 52 and the retainer member 53 is a second spring 54 which constantly biased the shaft 51 leftwardly as viewed in FIG. 2 so that the shaft 51 may push the valve member 36 toward the opened position thereof. The second spring 54 is made of a shape memory alloy so that the spring 54 may expand to the memorized shape at a high temperature (over approximately 50° C.). If the retainer member 53 is made of a heat insulating material, the second spring 54 will be thermally insulated from the solenoid 47, whereby the second spring 54 will become independent of heat generated by the solenoid coil 47.

A rubber cap 55 engaged with the outer periphery is plugged with epoxy resin 56 so as to prevent foreign matter such as water from penetrating the solenoid coil 47.

In operation, when the engine ignition switch 11 (viewed in FIG. 1) is turned off and no electric current is applied to the solenoid coil 47, the axial movement of the valve member 36 will depend on the balance of biasing force between the first spring 37 and the second spring 54. When the temperature in the carburetor float chamber 16 is kept high, the second spring 54 will be maintained in an expanded shape which is memorized beforehand, whereby the load of the second spring 54 is greater than that of the first spring 37. As a result, the shaft 51 will be axially moved leftwardly as viewed in FIG. 2 by the biasing force of the second spring 54, whereby the shaft 51 will push the valve member 36 in the direction separating the valve member 36 from the seat member 38. Therefore, communication between the inlet port 32 and the outlet port 33 can be established, whereby the fuel evaporative gases produced in the carburetor float chamber 16 can be adsorbed on the canister 17. When the temperature in the carburetor float chamber 16 falls below a predetermined value (approximately 50° C.), the second spring 54 will contract so that the load of the first spring 37 may be greater than that of the second spring 54. Therefore, the valve member 36 will be in engagement with the seat member 28 by a rightward biasing force of the first spring 37, thereby closing the penetrating hole 39 and then blocking the communication between the inlet port 32 and the outlet port 33.

Next, when the ignition switch 11 is turned on and an electric current is applied to the solenoid coil 47, a magnetic circuit will be formed between the inner core 43 and the yokes 40, 41 by the energization of the solenoid coil 47, whereby the plunger member 49 positioned in the magnetic circuit can be attracted by the inner core 43. Therefore, the shaft 51 fixed in the plunger member 49 will be moved in a direction for being separated from the valve member 36 against the biasing force of the second spring 54, so that the valve member 36 can be maintained in the closed position by the biasing force of the first spring 37. Thus, during the energization of the solenoid coil 47 the valve member 36 can be maintained in the closed position in spite of the changes in the temperature, thereby blocking the communication between the inlet port 32 and the outlet port 33.

Figure 3:
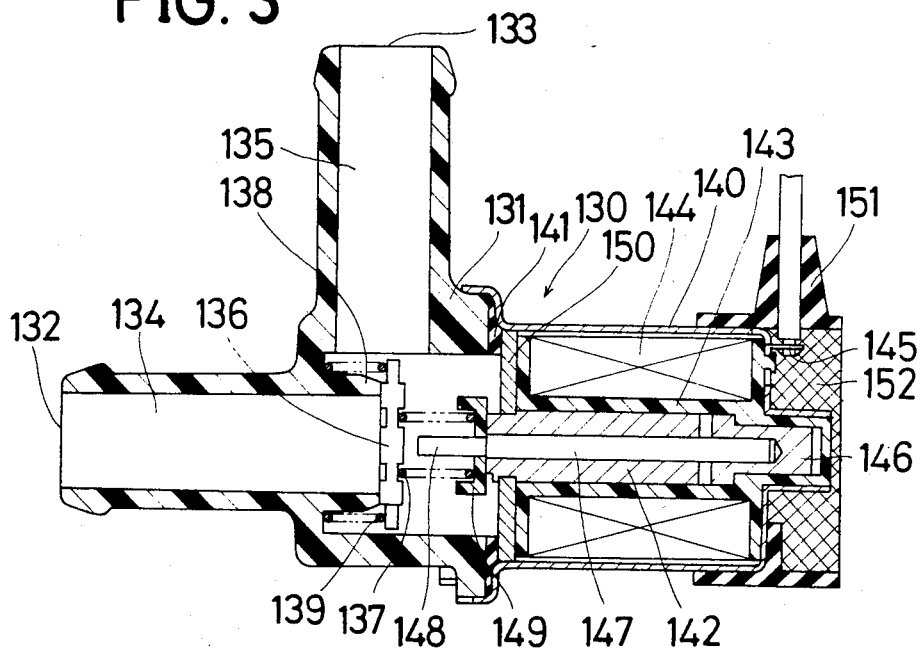
FIG. 3 is a sectional view of a control valve device constructed in accordance with a second embodiment of the present invention.

In a second embodiment shown in FIG. 3, a control valve device 130 includes a body member, made of synthetic resin, which has an inlet port 132 connected with carburetor float chamber 16 and an outlet port 133 connected with canister 17. The body member 131 is provided with fluid passages 134, 135 through which the inlet port 132 and the outlet port 133 communicate with each other. Communication between the inlet port 132 and the outlet port 133 is controlled by a valve member 136 positioned between the fluid passages 134, 135. The valve member 136 is constantly biased by a first spring 137 in the direction engaging with a valve seat 138 formed on the body member 131, namely in the direction of the closed position thereof. At the same time, the valve member 136 is constantly biased in the direction of the opened position thereof by a second spring 139 made of a shape memory alloy. The second spring 139 is set so that the load of the first spring 137 may be greater than that of the second spring 139 at a low temperature, thereby maintaining the valve member 136 in the closed position as shown in FIG. 3. Furthermore, the second spring 139 is set so that the second spring 139 may expand to a memorized shape at a high temperature (over approximately 50° C.). Therefore, the load of the second spring 139 will be greater than that of the first spring 137, at high temperature, thereby maintaining the valve member 136 in the opened position separated from the valve seat 138.

A yoke 140 made of a material of high magnetic permeability is fixedly secured on the rightward opened end of the body member 131 through a rubber seal 141. Disposed on the central axis in the yoke 140 is an inner core 142 made of a suitable magnetic material. Disposed on the outer periphery of the inner core 142 is a hollow cylindrical bobbin 143 made of a suitable nonmagnetic material. Wound on the bobbin 143 is a solenoid coil 144 which is electrically connected with a suitable electric source through a terminal 145 to generate a magnetic force. When an electric current is applied to the solenoid coil 144, a magnetic circuit will be formed by the action of the energization of the solenoid coil 144. A plunger member 146 made of a suitable magnetic material is positioned in the above-mentioned magnetic circuit. The plunger member 146 is slidably disposed on the same axis with the inner core 142 so that the plunger member 146 may face the rightward end of the inner core 142 each other. A shaft 147 is fixed in the plunger member 146 at one end thereof and protrudes from the leftward end of the inner core 142 at the opposite end thereof. Fixed on the protrusion 148 is a retainer 149 which supports one end of the first spring 137.

The solenoid coil 144, the first spring 137, the valve member 136 and the second spring 139 are positioned in this order in the axial direction in the body member 131 so that the second spring 139 is positioned apart form the solenoid coil 144. Therefore, the second spring 139 made of a shape memory alloy is independent of heat generated by the solenoid coil 144. If a ring member 150 fixed on the inner core 142 is made of a heat insulating material, the second spring 139 will thermally be separated from the solenoid coil 144 by means of the ring member 150, thereby preventing the heat generated by the solenoid coil 144 from influencing on the second spring 139.

A rubber cap 151 engaged with the outer periphery is plugged with epoxy resin 152 so as to prevent foreign matter such as water from penetrating the solenoid coil 144.

In operation, when the ignition switch 11 is turned off and no electric current is applied to the solenoid coil 144, the axial movement of the valve body 136 will depend on the balance of biasing force between the first spring 137 and the second spring 139. When the temperature in the carburetor float chamber 16 is kept high, the second spring 139 will be maintained in an expanded shape which is memorized beforehand, whereby the load of the second spring 139 is greater than that of the first spring 137. As a result, the valve member 136 can be separated from the valve seat 138 by the rightward biasing force of the second spring 139. Therefore, communication between the inlet port 132 and the outlet port 133 will be established, whereby the fuel evaporative gases produced in the carburator float chamber 16 can be adsorbed on the canister 17. When the temperature in the carburetor float chamber 16 falls below a pretetermined value (approximately 50° C.), the second spring 139 will contract so that the load of the first spring 137 may be greater than that of the second spring 139. Therefore, the valve member 136 will be in engagement with the valve seat 138 by a leftward biasing force of the first spring 137, thereby blocking the communication between the inlet port 132 and the outlet port 133 and then blocking the communication between the carburetor float chamber 16 and the canister 17.

Next, when the ignition switch is turned on and an electric current is applied to the solenoid coil 144, a magnetic circuit will be formed between the inner core 142 and the yoke 140 by the action of the energization of the solenoid coil 144, whereby the plunger member 146 positioned in the magnetic circuit can be attracted by the inner core 142. Therefore, the shaft 147 fixed in the plunger member 146 will be moved leftwardly viewed in FIG. 3 so that the protrusion 48 may push the valve member 136. As a result, the valve member 136 can be maintained in the closed position. Thus, during the energization of the solenoid coil 144 the valve member 136 can be maintained in the closed position in spiet of the changes in the temperature, thereby the blocking the communication between the inlet port 132 and the outlet port 133.

Figure 4:
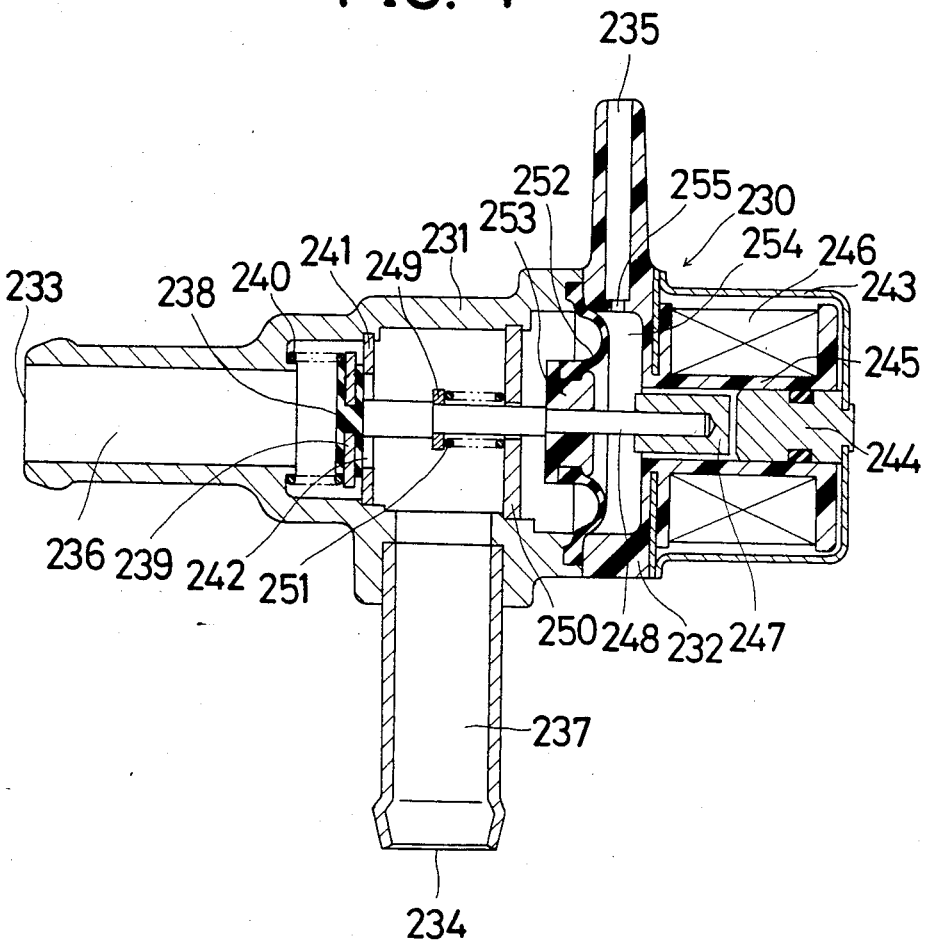
FIG. 4 is a section view of a control valve device constructed in accordance with a third embodiment of the present invention.

In a third embodiment shown in FIG. 4, a control valve device 230 includes a first body member 231 of metal material and a second body member 232 of resin material which are integrally connected forming a unitary body member. The first body member 231 is provided with an inlet port 233 connected with the carburetor float chamber 16 and an outlet port 234 connected with the canister 17, while the second body member 232 is provided with a vacuum inlet port 235 connected with an intake manifold of an internal combustion engine. Furthermore, the first body member 231 is provided with fluid passages 236, 237 through which the inlet port 233 and the outlet port 234 are connected with each other. Positioned between the fluid passages 236, 237 is a valve member 238 of rubber material having a metal plate 239 therein for reinforcement. The valve member 238 is constantly biased by a first spring 240 in the direction engaging a seat member 241 fixed in the body member 231, namely in the direction of the closed position thereof. The seat member 241 is provided with a penetrating hole 242 at the center portion thereof through which communication between both the ports 233, 234 can be established when the valve member 238 is maintained to be separated from the seat member 241.

A yoke 243 made of a material of high magnetic permeability is fixedly secured on the rightward opened end of the second body member 232. Disposed on the central axis in the yoke 243 is an inner core 244 made of a suitable magnetic material. Disposed on the outer periphery of the inner core 244 is a hollow cylindrical bobbin 245 made of a suitable magnetic material an integrally formed as a unitary body with the second body member 232. Wound on the bobbin 245 is a solenoid coil 246 which is electrically connected with a battery 12 viewed in FIG. 1 through a suitable electric terminal. A plunger member 247 made of a suitable magnetic material is positioned in a magnetic circuit formed by the action of the energization of the solenoid coil 246. The plunger member 247 is slidably disposed on the same axis with the inner core 244 so that the plunger member 247 may face the inner core 244. A shaft 248 is fixed in the plunger member 247 at one end thereof and faces the valve member 238 at the opposite end thereof. When the shaft 248 pushes the valve member 238, the valve member 238 will be separated from the seat member 241. A ring member 249 is secured on the shaft 248, and a retainer member 250 is secured on the inner wall of the first body member 231. Interposed between the retainer member 250 and the ring member 249 is a second spring 251 which constantly biases the shaft 248 leftwardly as viewed in FIG. 4 so that the shaft 248 may push the valve member 248 toward the open position thereof. The second spring 251 is made of a shape memory alloy so that the spring 251 may expand to the memorized shape at a high temperature (over approximately 50° C.). If the retainer member 250 is made of a heat insulating material, the second spring 251 will be thermally insulated from the solenoid coil 246, whereby the second spring 251 will become independent of heat generated by the solenoid coil 246.

Defined within the second body member 232 by a flexible diaphragm 252 is a vacuum chamber 254 which is connected with the engine intake manifold 22 viewed in FIG. 1 by means of an orifice passage 255 and the vacuum inlet port 235. The periphery of the diaphragm 252 is rigidly secured between the first and second body members 231, 232, while the inner circumference of the diaphragm 252 is firmly secured on the shaft 248 through a retainer 253. The diaphragm 252 is made of rubber or other suitable flexible material to enable movement of the center portion thereof in response to vacuum changes within the vacuum chamber 254. When the vacuum is introduced into the vacuum chamber 254, the shaft 248 will be moved with the diaphragm 252 in the rightward direction as viewed in FIG. 4 so that a gap between the plunger member 247 and the inner core 244 may be reduced.

In operation, when the engine ignition switch 11 (viewed in FIG. 1) is turned off and no electric current is applied to the solenoid coil 246, the axial movement of the valve member 238 will depend on the balance of biasing forces between the first spring 240 and the second spring 251. The operation of the valve member 238 is the same with the fist embodiment shown in FIG. 2.

Next, when the ignition switch 11 is turned on and an electric current is applied to the solenoid coil 256, the valve member 238 is maintained in the closed position in spite of changes in the temperature as mentioned in the first embodiment. At this time, since the vacuum is introduced in the vacuum chamber 254, the shaft 248 will be moved with the diaphragm 252 in the rightward direction so that a gap between the plunger member 247 and the inner core 244 may be reduced. Accordingly, it may be possible to reduce the magnetic force generated by the solenoid coil 246 and then to reduce the electric current applied to the solenoid coil 246.

Figure 5:
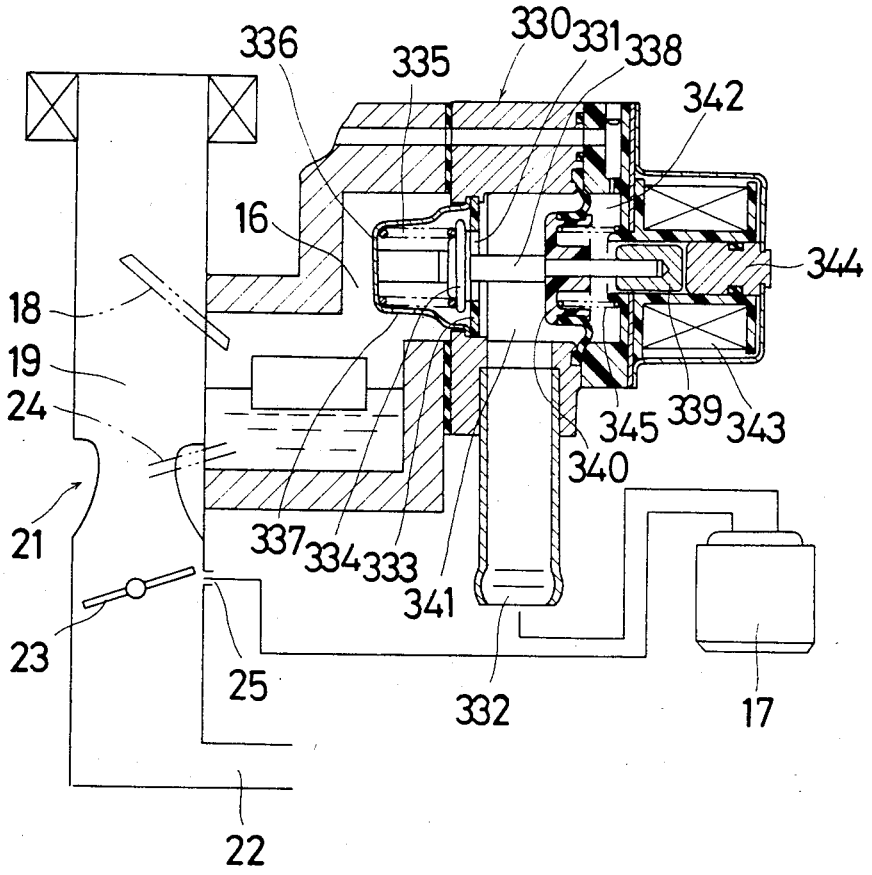
FIG. 5 is a sectional view of a carburetor outer vent control system incorporating a control valve device constructed in accordance with a fourth embodiment of the present invention.

In FIG. 5 is shown a carburetor outer vent control system wherein a control valve device 330 according to a fourth embodiment is installed in a carburetor float chamber. In the carburetor outer vent control systems shown in FIG. 1 and FIG. 5, corresponding parts are designated with the same reference numerals. The control valve device 330 includes an inlet port 331 connected with the carburetor float chamber 16 and an outlet port 332 connected with the canister 17. The inlet port 331 is controlled to be opened and closed by means of a valve seat 333 and a valve member 334 which is constantly biased toward the valve seat 333 by a first spring 335. A spring retainer 336 supports the spring 335 and includes a hole 337 connecting the inlet port 331 with the carburetor float chamber 16.

A shaft 338 faces the valve member 327 at one end thereof and is fixed in a plunger member 339 at the opposite end thereof. An interior of the device 330 is divided by a diaphragm 340 into a chamber 341 connected with the outlet port 332 and a vacuum chamber 342 connected with the outlet port 332 and a vacuum chamber 342 connected with an intake manifold vacuum source. When an electric current is applied to a solenoid coil 343, the plunger member 339 is attracted by an inner core 344.

Interposed in the vacuum chamber 342 is a second spring 345 made of a shape memory alloy so that at a high temperature the spring 345 may be maintained in an elongated shape which is memorized beforehand. The fuel evaporative gases are supplied to the induction passage 19 through a purge port 25. Fuel is discharged from the float chamber 16 to the induction passage 19 through a fuel outlet 24.

It should be understood that the preferred embodiments of the present invention have been described herein in considerable detail and that certain modifications, changes, and adaptations may be made therein by those skilled in the art and that it is hereby intended to cover all modifications, changes and adaptations thereof falling within the scope of the appended claims.

What is claimed is:

1. A control valve device for an internal combustion engine having a carburetor outer vent control system, a carburetor float chamber and a canister, said device controlling fluid communication in a fluid passage in response to an input current signal from a switch device and changes in ambient temperature, comprising:

a body member having an inlet port and an outlet port;

a fluid passage formed in said body member and connecting said inlet port and said outlet port;

a valve member disposed in said fluid passage and controlling fluid communication in said fluid passage;

a first spring biasing said valve member in a direction closing said fluid passage;

a solenoid coil connected to said body member forming a magnetic circuit by receiving an input current;

a plunger member positioned in said magnetic circuit and attracted by an inner core upon energization of said solenoid coil;

a shaft fixed to said plunger member at one end and facing said valve member at the opposite end;

a second spring biasing said valve member in a direction opening said fluid passage, wherein said second spring is coil-shaped, is made of a shape memory alloy and is expandable to a memorized shape at a high temperature; and a retainer member made of a heat insulating material interposed between said solenoid coil and said second spring so as to thermally insulate said second spring from said solenoid coil wherein said inlet port is connected to said carburetor float chamber and said outlet port is connected with said canister of said internal combustion engine and wherein said device is installed in said carburetor float chamber.

2. A control valve device as defined in claim 1, wherein said solenoid coil, said first spring, said valve member and said second spring are positioned in this order in an axial direction in said body member so as to locate said second spring apart from said solenoid coil.

3. A control valve device as defined in claim 2 further comprising a ring member made of a heat insulating material interposed between said solenoid coil and said first spring.

4. A control valve device as defined in claim 3, further comprising a flexible diaphragm fixed on said shaft so as to define a vacuum chamber.

5. A control valve device as defined in claim 4, further comprising an engine intake manifold wherein said vacuum chamber is connected with said engine intake manifold through an orifice passage.

6. A control valve device as defined in claim 4, wherein said second spring is located in said vacuum chamber.

7. A control valve device as defined in claim 1, wherein said second spring is maintained at approximately 50° C. in an expanded shape memorized beforehand.

* * * * *